US006215411B1

(12) United States Patent
Gothard

(10) Patent No.: US 6,215,411 B1
(45) Date of Patent: Apr. 10, 2001

(54) REMOTE CONTROL ELECTRONIC DISPLAY SYSTEM

(76) Inventor: David L. Gothard, 407 Indigo Springs, Henderson, NV (US) 89014

( * ) Notice: Subject to any disclaimer, the term of this patent is extended or adjusted under 35 U.S.C. 154(b) by 0 days.

(21) Appl. No.: 09/500,284

(22) Filed: Feb. 8, 2000

Related U.S. Application Data

(63) Continuation of application No. 09/132,456, filed on Aug. 11, 1998

(60) Provisional application No. 60/083,597, filed on Apr. 30, 1999.

(51) Int. Cl.[7] ..... G08B 5/00

(52) U.S. Cl. ..... 340/815.4; 340/815.47; 340/815.49; 340/815.6; 340/825.69; 340/825.72; 40/624; 40/446; 345/2; 345/328

(58) Field of Search ..... 340/815.4, 815.47, 340/815.49, 815.6, 539, 907, 825.69, 825.72; 40/541, 624, 902, 446; 345/328, 1, 2, 60–72

(56) References Cited

U.S. PATENT DOCUMENTS

| | | | | |
|---|---|---|---|---|
| 5,089,745 | * | 2/1992 | Iannini | 315/76 |
| 5,218,629 | * | 6/1993 | Dumon et al. | 379/59 |
| 5,295,064 | * | 3/1994 | Malec et al. | 364/101 |
| 5,844,181 | * | 12/1998 | Amo et al. | 187/396 |

* cited by examiner

*Primary Examiner*—Julie Lieu
(74) *Attorney, Agent, or Firm*—Robert J. Schaap

(57) ABSTRACT

A remotely controlled electronic display sign which operates with a plasma display and which provides for humidity control and the like allowing the sign to be used in various environments. The sign is essentially self-contained and includes those components necessary for enabling a display of desired material from a remote control source. A controller in or associated with the sign is accessible either electrically, or through satellite transmission or other wireless transmission from the remote source which allows the display of the sign to be changed at will. Thus, an operator at a remote source may, with the aid of a pre-prepared graphic design, transmit that design to the controller at or associated with the sign for display of that graphic information.

33 Claims, 7 Drawing Sheets

REMOTE CONTROL ELECTRONIC DISPLAY SYSTEM

RELATED APPLICATION

This application is a continuation of U.S. patent application Ser. No. 09/132,456, filed Aug. 11, 1998, for "Remote Control Electronic Display System" and which is, in turn, a continuation-in-part of my provisional patent application Serial No. 60/083,597, filed Apr. 30, 1999, also entitled "Remote Control Electronic Display System";

BACKGROUND OF THE INVENTION

1. Field of the Invention

This invention relates in general to certain new and useful improvements in display signs, and more particularly, to remotely controlled electronically operable display signs in which a display on a sign may be changed at will from a remote source.

2. Brief Description of Related Art

Display signs are used in a wide variety of industries, frequently as promotional and advertising aids. Thus, many retail stores will employ display signs in the front of their stores or elsewhere featuring products which are being sold or otherwise offered by that establishment. Display signs are also frequently used for traffic control by various municipalities and governmental agencies.

Essentially all display signs presently available are static in that they carry a substrate with a message or design thereon and which is to be conveyed, as for example, a paper sheet having information thereon for display and which may be frequently mounted behind a transparent member such as a sheet of glass.

In many cases, the poster or other display sheet may be mounted within a frame having a light source mounted therein. In this case, the front face of the sheet may be lighted from lights located along portions of the periphery of the frame. In some cases, when using a somewhat transparent or translucent sheet, back lighting may also be employed.

The cost of preparing display signs made with paper and paper-board substrates can be quite substantial. Initially, the art work must be prepared often times by hand, although certain computer aids for purposes of preparing the drawing may be available. Nevertheless, preparation of the drawing is labor intensive. Thereafter, multi-color printing is usually required in order to complete the preparation of the paper or paper-board sign or display. These various steps, as indicated, are labor intensive and therefore materially add to the overall costs of preparing a sign or display, particularly when made of a paper or paper-board material.

In addition to the foregoing, there are also costs involved in the shipping or transport of these signs. Generally, they cannot be folded or bent or they would otherwise be unsuitable for use. As a result, special precautions and shipping containers must be provided for transport of the paper or paper-board substrate signs or displays.

There have also been display signs which use a frame and a source of light along with a glass sheet having an image or other information literally formed on the sheet, as for example, by means of glass etching, masking, or the like. However, with this type of display, when it is necessary or desirable to change the display in the sign, it is necessary to prepare a new piece of glass or otherwise a masking on a rear surface thereof having other information presented thereon.

Here again, the cost of preparing an etched glass sheet can be quite substantial. The same also holds true of preparing glass sheets with masks on the rear surface thereof to create a design or display with that sheet. Again, because of the frailty of these sheets, substantial precautions must be taken for the transport or shipment of these sheets.

There is presently no display sign capable of having information changed thereon as quickly as information can be changed on the screen of a computer monitor. Moreover, and independently thereof, there is presently no effective display sign which can be changed from a remote location.

OBJECTS OF THE INVENTION

It is, therefore, one of the primary objects of the present invention to provide an electronic display sign which uses a plasma display image and which can readily be changed in accordance with electronic signals applied thereto.

It is another object of the present invention to provide an electronic display sign of the type stated which can be altered rapidly through the use of a computer or otherwise through an image scanner.

It is a further object of the present invention to provide an electronic display sign of the type stated which can be controlled from a remote source and the display on the sign can be changed at will from that remote source.

It is an additional object of the present invention to provide a display sign of the type stated which completely eliminates the need for interchangeable substrates bearing the information to be displayed.

It is also an object of the present invention to provide an electronic display sign and a method of altering a display on a sign electronically and without using interchangeable substrates bearing information to be displayed.

It is another salient object of the present invention to provide a method of displaying information by generating that information from a remote source and transmitting that information to a display sign.

It is still another object of the present invention to provide a unique circuit enabling operation of a display sign from a remote source.

With the above and other objects in view, my invention resides in the novel features of form, construction, arrangement and combination of parts presently described and pointed out in the claims.

BRIEF SUMMARY OF THE INVENTION

The present invention relates in general terms to a display system including a display sign which is electronically accessible from a remote source and which enables the almost automatic change of a display pursuant to control of an operator at the remote source. In a broad sense, the display system of the present invention comprises a display sign having a display panel thereon as well as display generating means at the remote source for generating a display to be displayed on that display panel. The display is actually generated in the form of an electrical signal and the system comprises a transmitting means for transmitting the electrical signal representing the display to the display panel of that display sign.

The present invention also provides a method of generating a display on a display sign from a remote source. The method involves the steps of generating the display and then transmitting that display to the display sign in the form of electrical signals representing the display. The display sign is provided with electronics using the received electrical signal to recreate the generated display and present same on the display panel.

In one embodiment of the invention, the means for transmitting the display is an electrical conductor connected between the display sign and the display generating means at the remote source. In another embodiment of the invention, the means for transmitting the display is a wireless transmission means, such as by means of radio frequency transmission, satellite transmission, or the like.

In a more preferred embodiment of the invention, the means for generating the display comprises an image generating means which enables the generation of initial image forming part of the display and a temporary storage for temporarily storing that image. Editing means are also provided for adding material to or otherwise modifying the image. Thereafter, a permanent storage is provided to enable storage of the generated display in electrical format, at least until such time as transmission thereof to the display sign.

In still a more preferred embodiment, the apparatus comprises a scanning means for scanning a particular image and converting the image into electrical signals representative thereof. The image is then stored in the temporary storage. A keyboard input may be connected to that temporary storage for introducing information through a keyboard input. In addition, means is provided for adding other copy material. Thereafter, all of the material added can be edited by an operator to form a display. The display is then stored in a permanent storage.

At a predetermined time, the stored display can then be transmitted to a storage in the sign. Moreover, a plurality of different displays can be stored at the remote source and these displays can be sequentially transmitted to the display sign. In this way, an operator can manually or automatically control the generation of a plurality of desired displays in a predetermined time sequence.

The present invention not only allows for the display to be generated at the sign from a remote source, but it also allows for a plurality of displays to be presented in a desired format and in a desired predetermined time arrangement, as aforesaid. As a result, there is no need to use hard copy displays, such as pre-printed paper displays. Furthermore, minor changes can be electronically made in a display as, for example, minor price changes can be made without the necessity of re-printing.

The display which is generated and hence the electronic signal or electrical signal representative of that display is capable of producing only a static display, that is a display in which only a single display is depicted for a reasonable period of time usually for several minutes or longer. In other words, the display is not a continuous display as one might find in a cinematic display in which there are continuous displays of sequential and successive images with one repeating after the other. Thus, and in this respect, the term "static" is used to refer to an individual display which remains for a period of at least ten seconds or longer.

It is also to be understood in connection with the present invention that the displays of the type mentioned herein and, for that matter, the electronic signals or electrical signals representative of that display, are based on the copying of a pre-prepared image, as opposed to any form of live transmission. Thus, for example, an image at a remote site is copied and, perhaps, modified and that image is then converted to the necessary electrical signal or signals which is then transmitted. Thus, and in this respect, the term "scanned image" is used herein to represent an image used in a display which is based on the scanning of pre-prepared material.

The display sign is also of a unique construction in that it comprises means for controlling certain atmospheric conditions and, particularly, temperature in the display sign. Furthermore, an interference filter is formed on the surface of the display panel to preclude excess heat generation within the display sign. The display panel is preferably a plasma display, as hereinafter described in more detail.

The display sign preferably includes an outer housing which may be provided with a removable front face or so-called "cover". The front face is provided with an enlarged opening in order to enable a display panel to appear through that opening. A transparent protective sheet may be disposed over the display panel.

The housing is in the form of a rectangularly shaped box, although it may adopt other shapes. The major components which enable the display including the display panel are preferably mounted on a separate chassis to enable easy and convenient assembly of the display sign. The separate chassis is secured through the display box to a mounting station, such as a display stand. In this way, only one having authorized access to the interior of the display housing can disconnect the chassis and the mounting station.

The chassis in the preferred embodiment includes a power supply for operating the plasma display panel. In addition, the chassis may also comprise a second power supply for operation of a processor or computer within the housing. The computer is designed for connection to the temporary storage at the remote source and will receive generated displays in electrical signal format. The computer is programed to recreate those displays at the sign and generate the same through the plasma display panel. For this purpose, the computer is also mounted on the chassis.

As indicated previously, the images or displays which are to be generated at the display sign are represented by and transmitted in the form of one or more electrical signals or electronic signals. It is recognized that in many cases, transmission occurs either by electrical conductors, such as cable type transmission, or it may otherwise occur through a wireless type of transmission. Wireless transmission would inherently include radio frequency transmission, radio wave interference and the like. Wireless transmission would also include satellite intervention and transmission. However, it should be understood that since the signals which are transmitted were inherently electrical or electronic in nature, they are referred to as electrical or electronic signals whether or not they are transmitted over hard wired electrical conductors or over a wireless transmission means.

The housing is preferably provided with a plurality of openings extending primarily throughout the side wall thereof. Moreover, venting fans may also be provided for venting heated air in the housing to the exterior.

The foregoing objects and the advantages of this invention have been met and fulfilled by this system and method which has been briefly described in the general description. However, the invention will now be described in more detail in the following detailed description and in the accompanying drawings. Nevertheless, it is to be understood that these drawings and the following detailed description are only set forth for purposes of illustrating the general principles of the invention. Therefore, it should be understood that the accompanying drawings and the detailed description are not to be taken in a limiting sense.

BRIEF DESCRIPTION OF THE DRAWINGS

Figure 1:
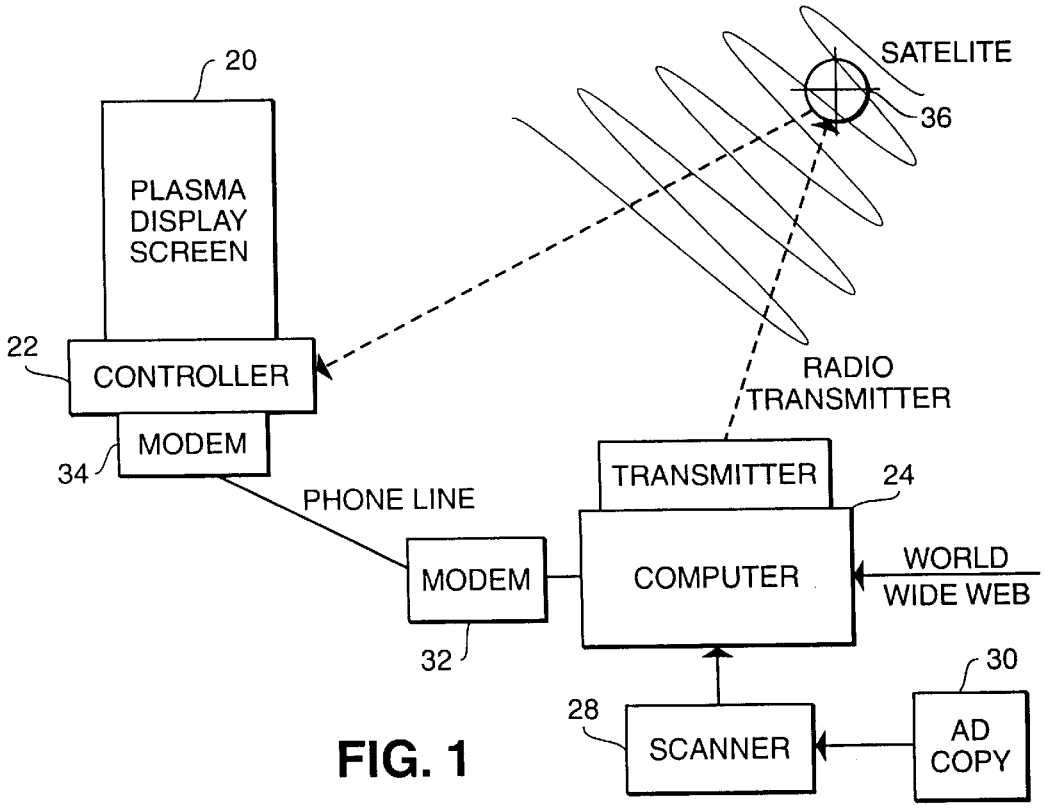
Figure 2:
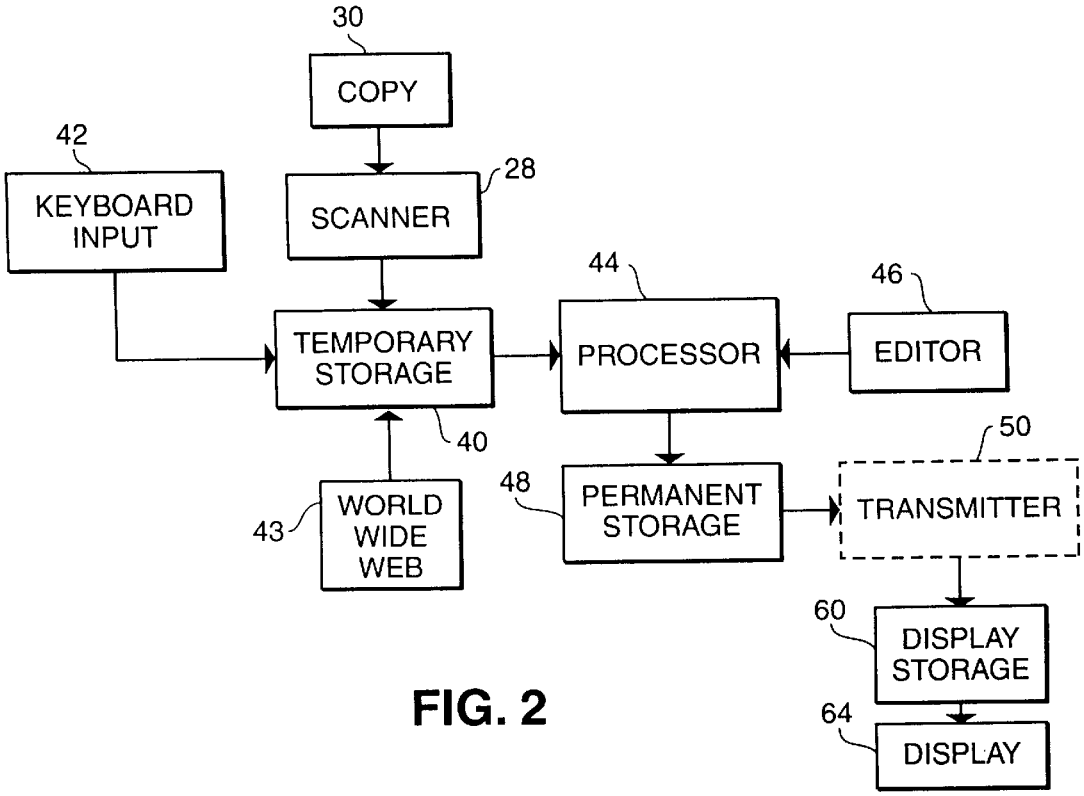
Figure 3:
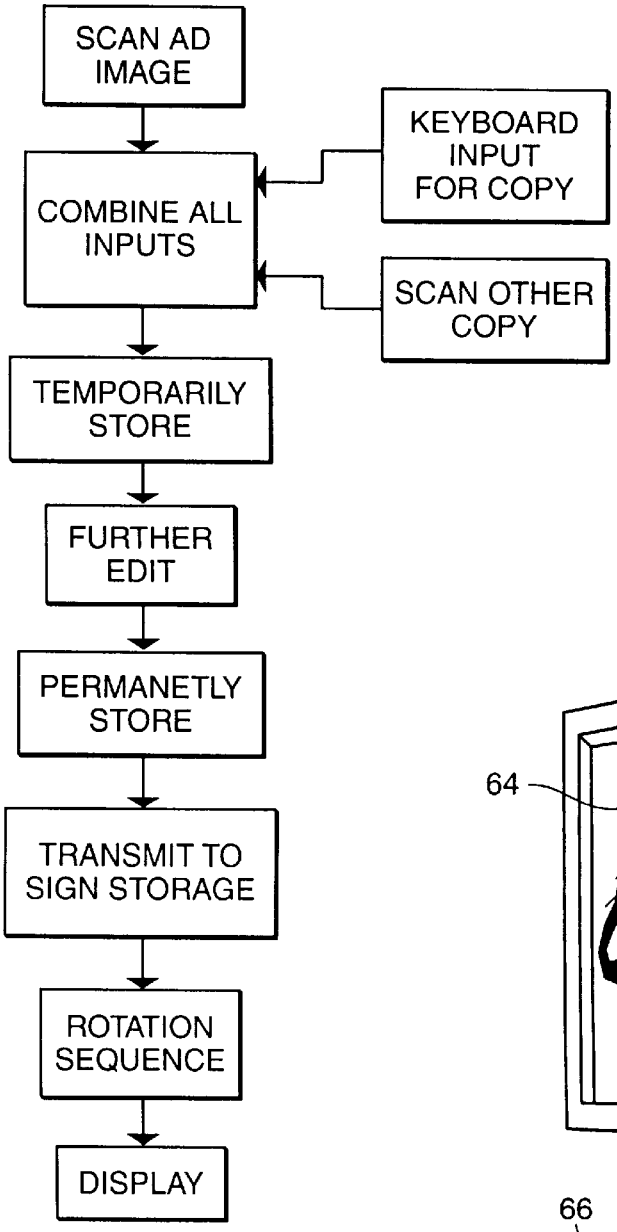
Figure 12:
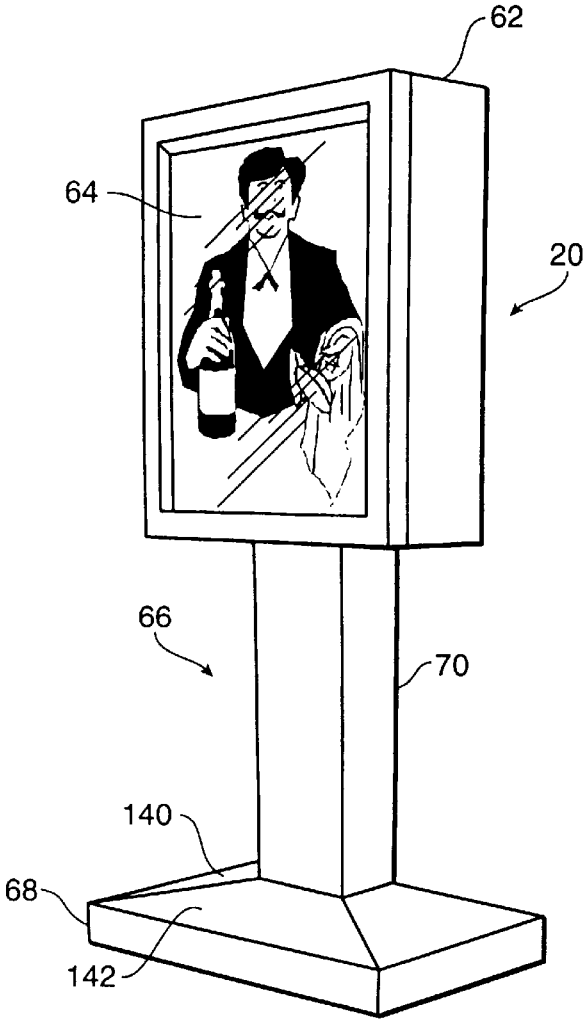
Figure 4:
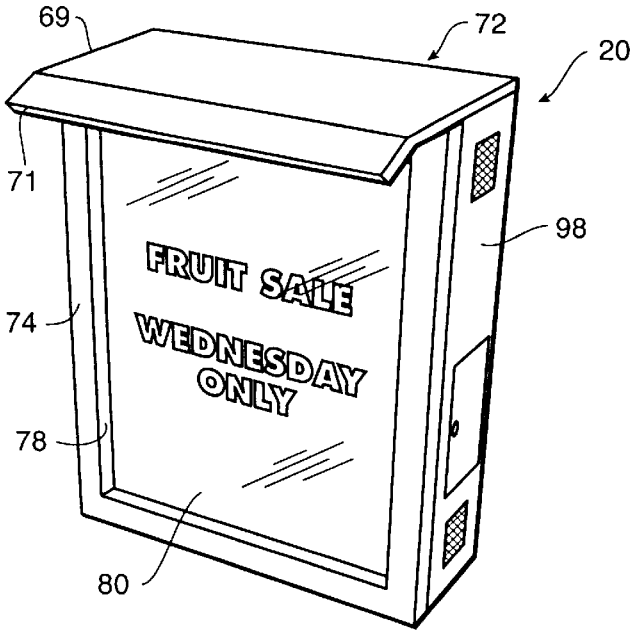
Figure 5:
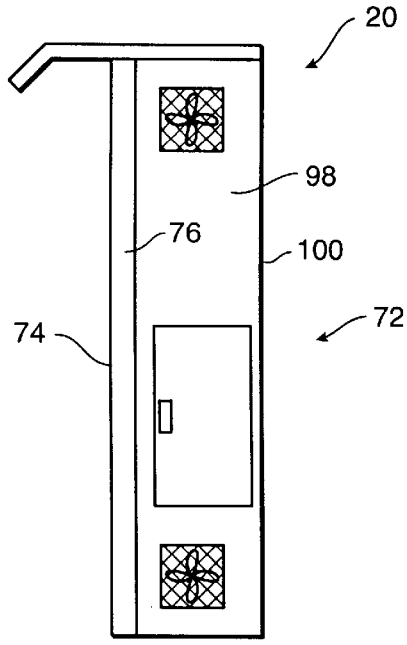
Figure 6:
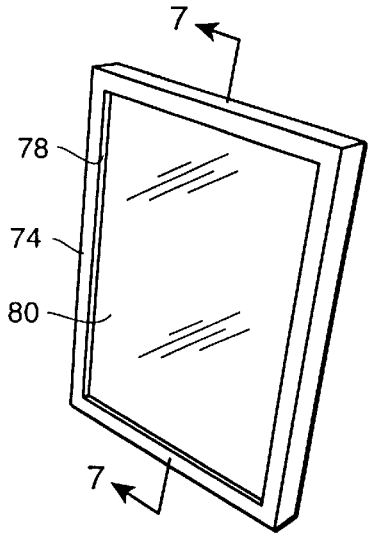
Figure 7:
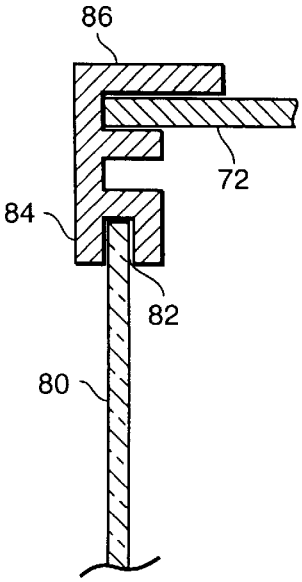
Figure 8:
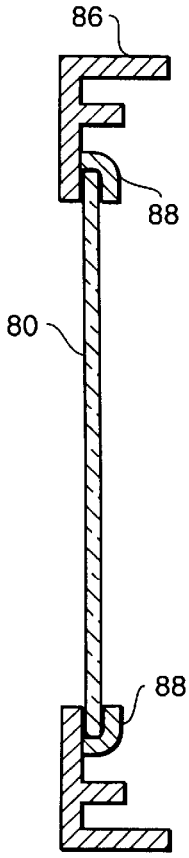
Figure 9:
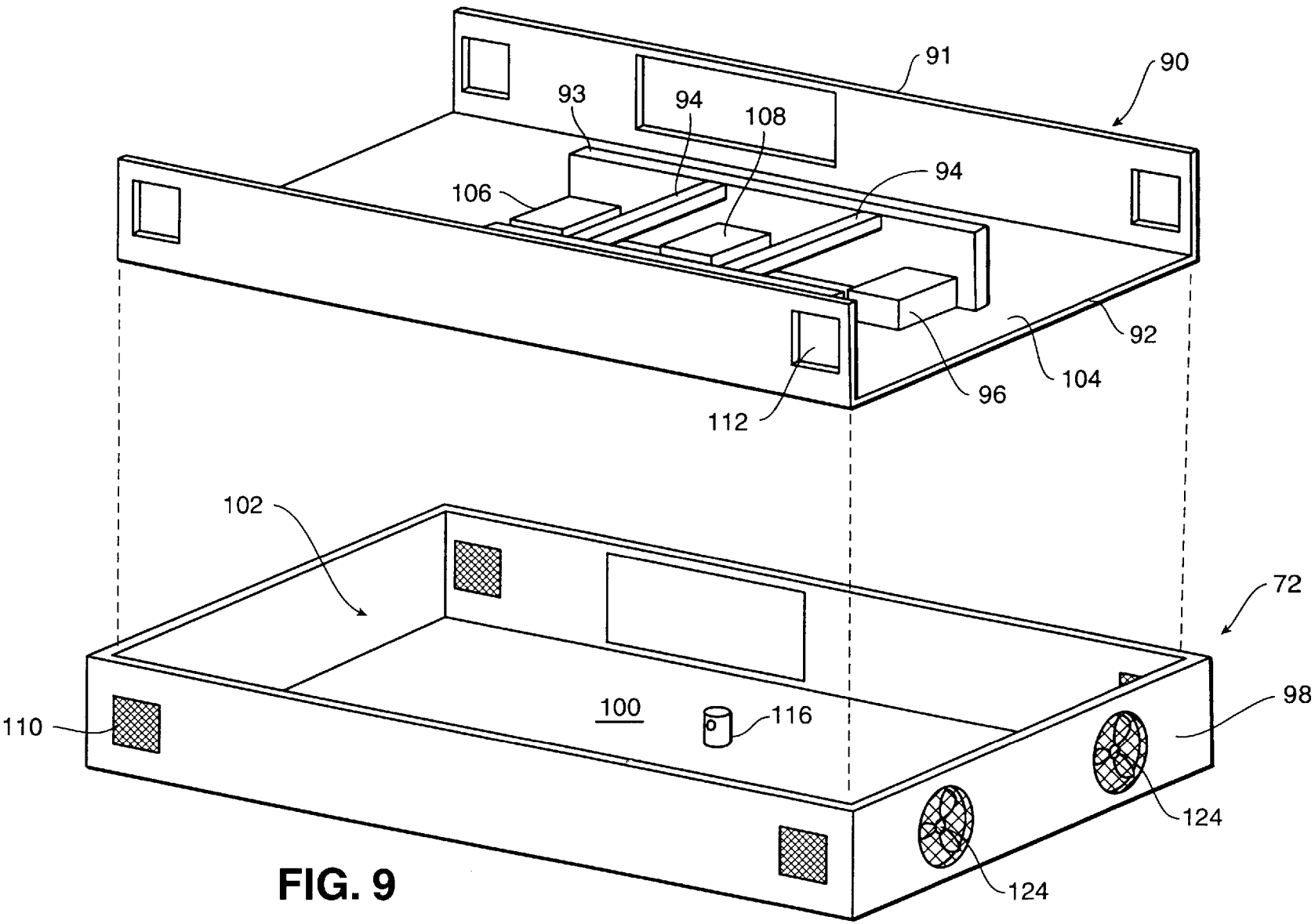
Figure 10:
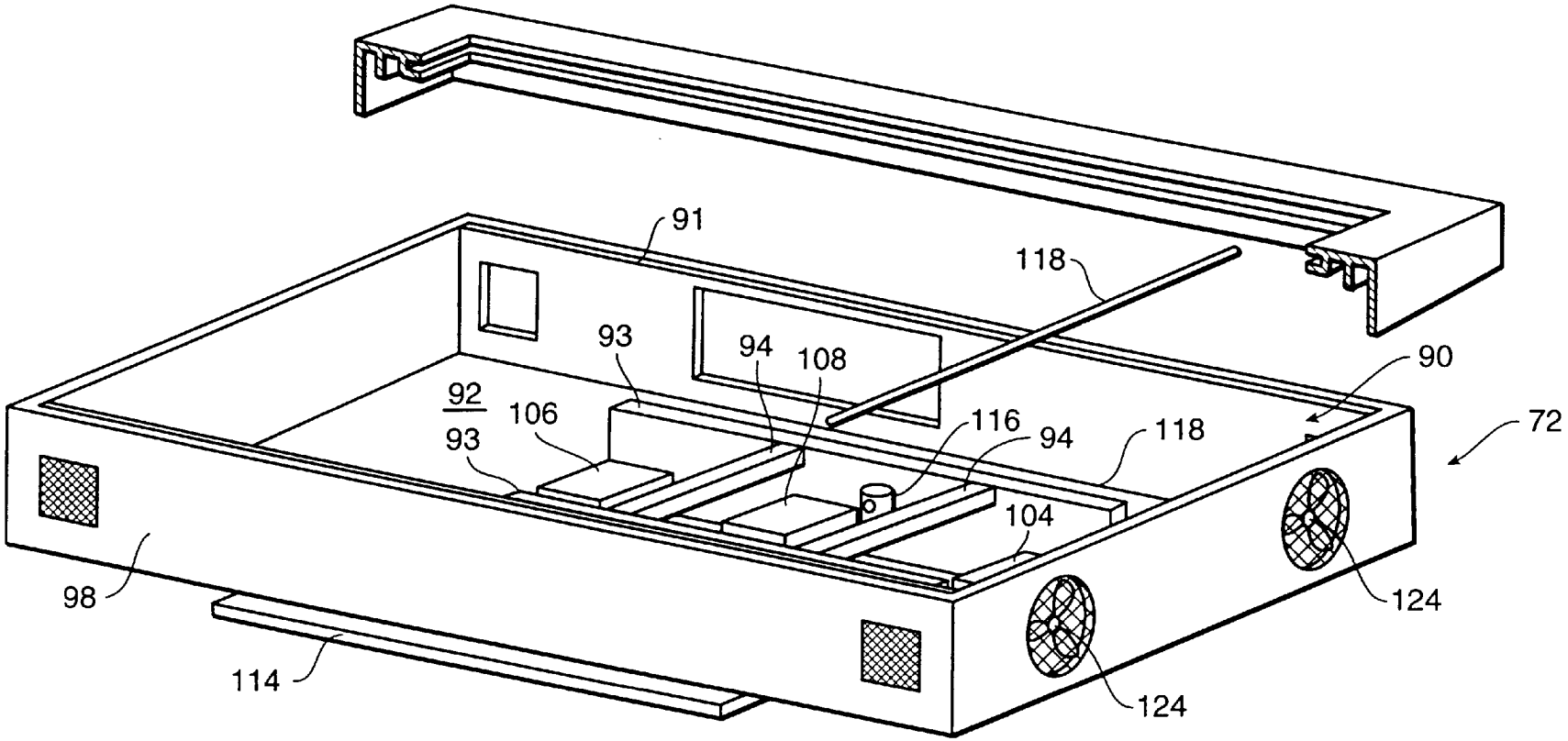
Figure 11:
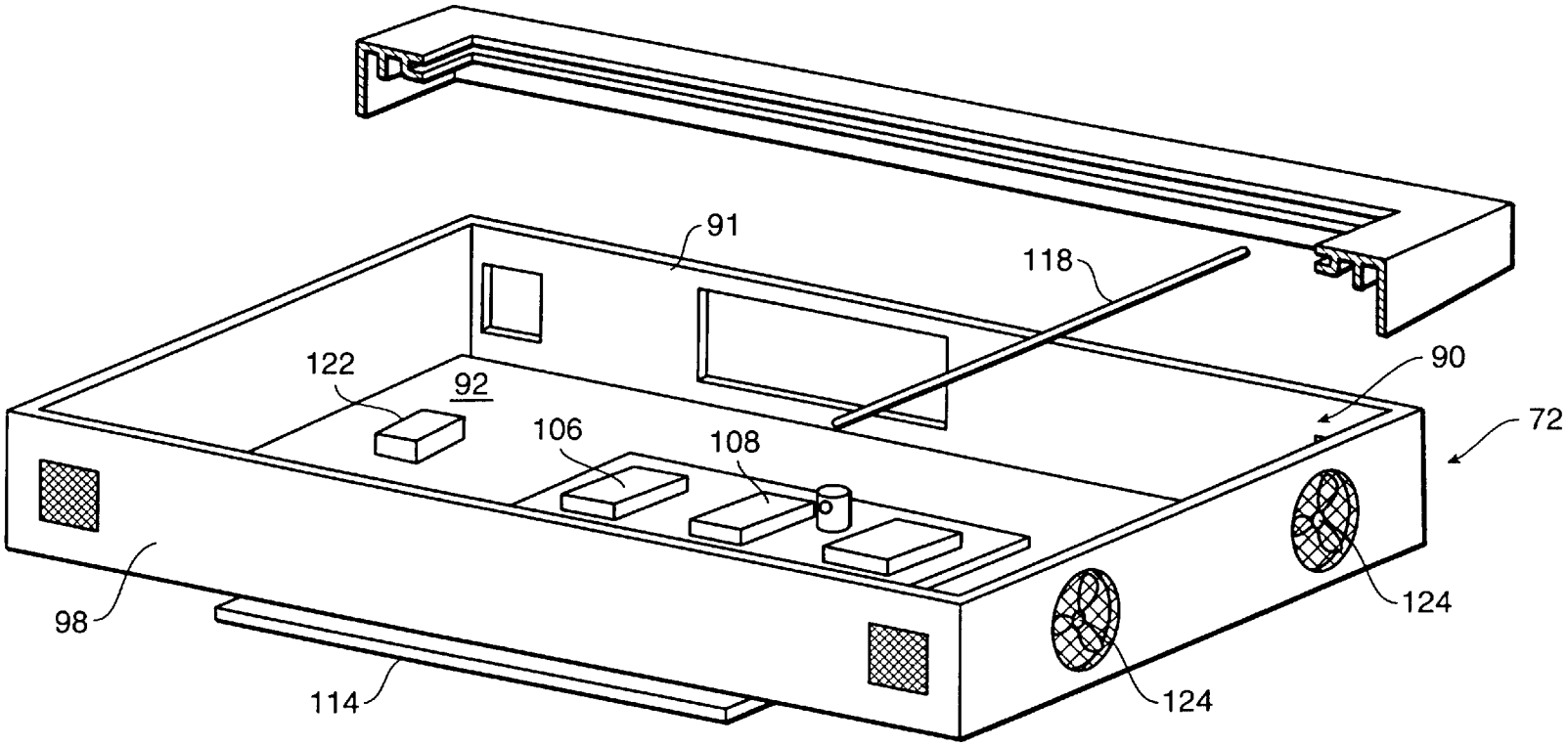
Figure 13:
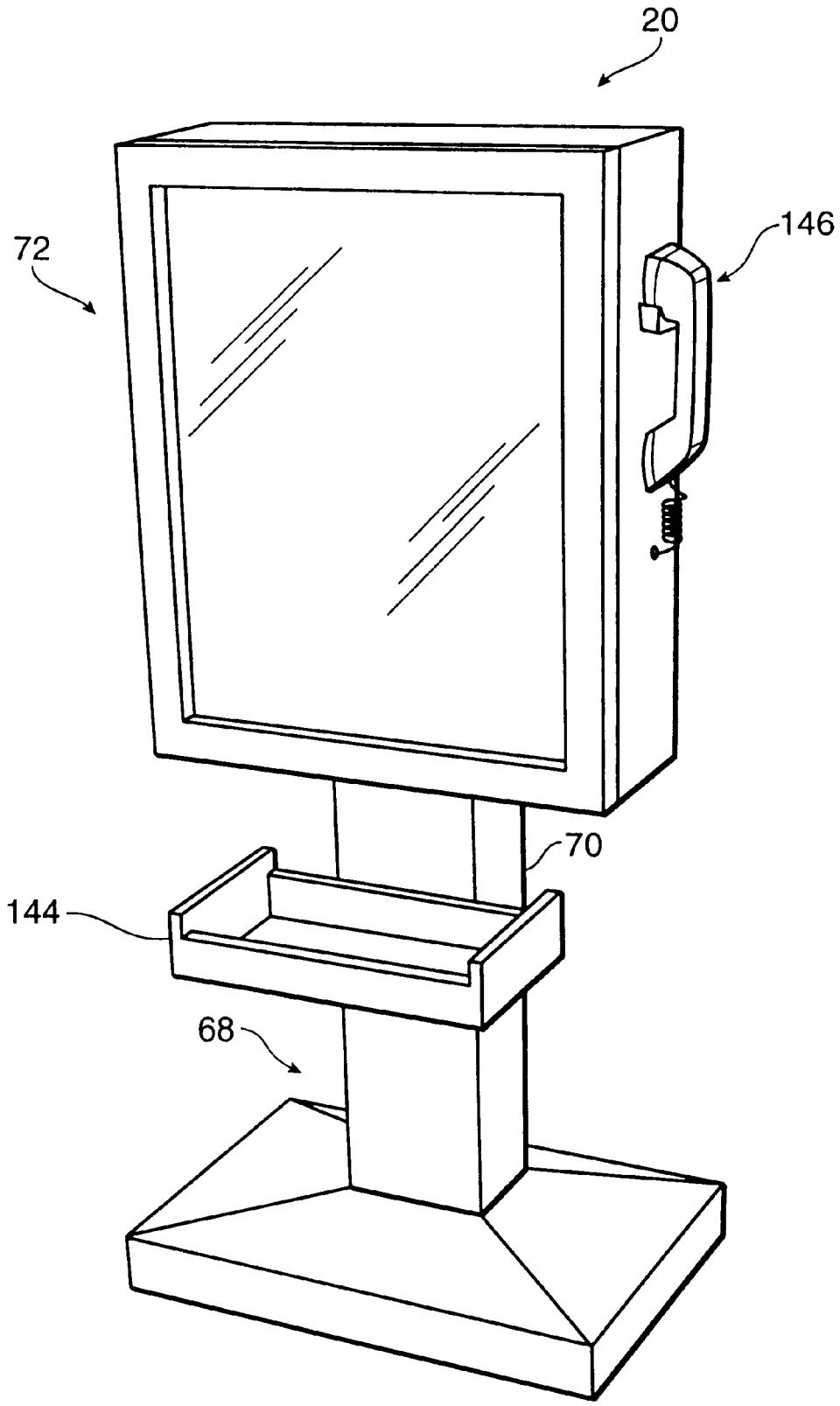

Having thus described the invention in general terms, reference will now be made to the accompanying drawings in which:

FIG. 1 is a schematic component view showing those elements necessary for generating a display either through hard wired conveyance or otherwise wireless conveyance of information;

FIG. 2 is a schematic circuit diagram showing major components necessary involved in the generation of an electronic display from a remote source;

FIG. 3 is a schematic flow diagram showing those steps involved in generating a display from a remote source;

FIG. 4 is a perspective view of one form of display sign constructed in accordance with and embodying the present invention;

FIG. 5 is a side elevational view of the display sign of FIG. 4;

FIG. 6 is a perspective view of a lid or cover which extends over the display sign;

FIG. 7 is a fragmentary vertical sectional view taken along line 7—7 of FIG. 6;

FIG. 8 is a vertical sectional view, similar to FIG. 7, and showing a slightly modified form of cover used with the display sign of the present invention;

FIG. 9 is an exploded perspective view showing some of the major components in the display sign of the present invention;

FIG. 10 is an exploded fragmentary perspective view, partially broken away, and somewhat similar to FIG. 9, and showing the various components in their assembled position;

FIG. 11 is an exploded fragmentary perspective view, similar to FIG. 10, and showing a modified form of display sign in accordance with the present invention;

FIG. 12 is a perspective view showing one type of mounting for a display sign construction in accordance with and embodying the present invention; and FIG. 13 is a fragmentary sectional view showing one form of panel construction used in the present invention.

Figure 14:
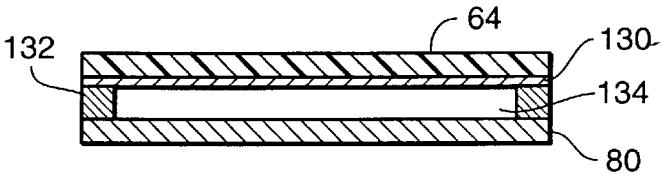

FIG. 14 is a vertical sectional view showing the construction of a filter arrangement used in the present invention.

DETAILED DESCRIPTION OF A PREFERRED EMBODIMENT

Referring now in more detail and by reference characters to the drawings, FIG. 1 illustrates the major components forming part of a display system D in accordance with the present invention. This display system primarily shows the generation of a display from electrical signals representative of that display at a remote location and transmission to a display sign for recreation on that display sign.

In accordance with the schematic illustration of FIG. 1, the display system D comprises a display sign 20. Incorporated within the display sign 20 or otherwise being connected to the display sign is a sign controller 22. This controller may adopt the form of a microprocessor or computer in the sign and preferably includes a storage, as hereinafter described in more detail.

The display system D of the invention further comprises a display generating means 24 at a remote source and which is usually comprised of a computer 26 which may adopt the form of a processor and storage, as well as a scanner 28. In the embodiment of the invention as shown, the scanner receives ad copy 30 and generates a display in electrical format which can then be transmitted from the computer 26 to the display sign 20.

FIG. 1 also illustrates both a hard wire conductor means for transmitting the generated display, as well as a wireless means for transmitting the generated display. For the purposes of hard wire conductor transmission, the computer 26 is provided with a modem 32 and the controller 22, and the display sign 20 is similarly provided with a corresponding modem 34. As indicated previously, wireless transmission is also available and could adopt the form of microwave signal transmission, radio frequency transmission, including satellite transmission, or the like. In this respect, the signal which is generated is still an electrical signal in either radio frequency format or other wireless transmission format for wireless transmission. For purposes of wireless transmission, a satellite 36, as shown, may be employed, such that the wireless transmission will follow the path 38 shown in the dotted lines of FIG. 1.

FIG. 2 illustrates those major components forming part of the display system of the present invention. In this case, the display system comprises the scanner 28 which is usually employed for purposes of generating the initial image. Typically, a pre-prepared image of the element to be displayed is used and scanned from the scanner 28 into a temporary storage 40. The image to be scanned by the scanner 28 may be a pre-drawn image or otherwise, it can be an image adopted from an existing source. The scanner 28 will effectively digitize the image and thereby store that digitized image into the temporary storage 40.

A keyboard input 42 is also connected to the temporary storage 40 for introducing information, such as typewritten information, into that storage. The temporary storage 40 operates in conjunction with a processor 44 and a manually operable editor 46. The editor 46 is primarily designed to manipulate the images introduced into the processor 44 and the information from the keyboard input 42 into a desired format. Thus, a user of the system can manually superpose one image over another or otherwise modify two images by blending them together, etc. The editor 46 merely contains controls to enable the processor 44 to perform those functions. In this sense, the editor could also be another keyboard input much in the same manner as a computer keyboard input.

The information from the temporary storage 40 is then introduced into a permanent storage 48 where it can be retained, either indefinitely, or at least until such time as it is transmitted to a display sign, as hereinafter described in more detail.

The display system of the invention may also comprise a transmitting means 50 in the form of a transmitter, which is schematically illustrated in FIG. 2. The transmitter means 50 may adopt any conventional form of a transmission means as, for example, the modems 32 and 34, or otherwise for wireless transmission, a radio frequency transmitter, etc.

The aforesaid components constitute those major components which will form part of the display system and the remote site. Thereafter, the images which form the displays along with the other incorporated information therein can be transmitted to a display storage 60 located at and forming part of a display sign 20. The display sign 20, through its own processor, as hereinafter described, enables the generation of a display on a display panel 64 forming part of the display sign 20. The display panel is also hereinafter described in more detail.

The display sign 62 may form part of or otherwise may be mounted on a stand 66, as best shown in FIG. 12. The stand 66 conventionally includes a base 68 as well as an upstanding leg 70, the latter of which would engage and support the display sign 20. However, it should also be understood that the display sign 20 could be provided with a mounting means, as hereinafter described, for mounting to a wall or like structure.

FIG. 3 illustrates some of the major steps associated with the method for generating a display from a remote source. In this case, it can be seen that an image, such as an advertising image, is scanned and digitized for introduction into a temporary storage, such as the temporary storage 40. Again, keyboard input information is also provided, as well as other copy information, as shown in FIG. 3. This other copy information is typically introduced through the scanner 28.

After the display has been formed, it is stored in the permanent storage 48 and then introduced into the display storage 60. FIG. 3 also illustrates a rotational sequence program which can be used at the remote site or at the display sign. Thus, various displays can be generated in sequence at the display sign and at pre-determined time intervals.

The display sign 20 is more fully illustrated in FIGS. 5–11 of the drawings. The display sign 20 generally comprises an outer housing 72, such as a rectangularly shaped housing. The housing is preferably formed of a metal and even more preferably a light weight metal, such as aluminum, although it could be formed of steel or other structural materials. In this respect, the housing could also be formed of plastics and even reinforced composite plastics.

The housing 72 is provided with a removable lid or cover plate 74 having a depending rim 76 which fits around a portion of the side wall of the housing 72. In addition, the lid or cover plate 74 is provided with an enlarged central opening 78 in order to enable the display panel 64 to appear therethrough. A transparent cover plate 80 could also be included in this opening 78 if desired. Furthermore, the removable lid or cover plate 74 is secured to the housing 72 in some manner as to preclude unauthorized opening as, for example, tamper-proof fasteners.

The transparent protective sheet 80 may be formed of an transparent plastic material or otherwise it may be formed of glass. However, glass is not preferred due to the fact that it will crack or shatter with any rough handling. The transparent protective sheet 80 is retained in a U-shaped grove 82 formed at the edge of the opening 78. This opening is formed by an integrally created U-shaped channel 84 surrounding the edge of the opening 78, as best illustrated in FIG. 7 of the drawings. In addition, the lid or cover member 74 is also provide with a U-shaped channel 86 perpendicularly arranged to the grove 82 and which is sized to receive the forwardly presented edge of the housing 72, as also best shown in FIG. 7 of the drawings.

FIG. 8 illustrates a slightly modified embodiment of the construction shown in FIG. 7. In place of the formation of a U-shaped channel 84, a plurality of brackets or tabs 88 affixed to the inside of the cover member 74 surrounding the opening 78, are used to hold the transparent sheet 80 in a fixed position. The remaining portions of the lid are substantially identical to those shown and described in connection with FIG. 7.

The operating components forming part of the display sign 20 are actually mounted on a chassis 90 disposed within the housing 72. The chassis 90 comprises a pair of longitudinally extending side plates 91 and which are connected by a bottom plate or chassis plate 93, as best shown in FIG. 9 of the drawings. Moreover, and by reference to both FIGS. 9 and 10, it can be seen that the chassis 90 is deposed within the housing 72, as hereinafter described. Mounted on the upper surface of the chassis plate 92 are a pair of longitudinally extending frame bars 93 and which are connected by transversely extending cross-bars 94. Moreover, the longitudinally extending frame members 93 and the cross-bars 94 can be mounted on a supporting plate 96. Although the supporting plate 96 is provided in a preferred embodiment, it is not absolutely necessary and this plate could be eliminated, if desired.

The housing 72 is preferably comprised of an enclosing side wall 98 and a rear wall 100 which extends thereacross and thereby forms an interior chamber 102. The chassis 90 can be secured to this rear wall 100 by means of screws or other fasteners (not shown) which extend through the back plate. However, other forms of securement could be provided for this purpose, as hereinafter described.

The major operating components of the display sign are mounted on this chassis which is located within the housing 72, as aforesaid. These major operating components include a power supply 104 for the computer 26 and the latter of which also contains the display storage 60. A separate power supply 108 is also mounted on the chassis plate 96 and provides operating current for the other components of the display housing. The computer is effectively a microprocessor and contains the storage, as aforesaid, as well as a random access memory and a processor for controlling the display of a sign and also is operated from a control source at a remote location. Thus, and in this respect, the computer 106 is effectively a "slave" computer in that it receives instructions from the remote source and performs those instructions in the display sign by generating the proper display in accordance with the signals submitted to the computer 106.

Located on and secured to the upper surface of the chassis 90 is the display panel 64. In a preferred embodiment of the invention, the display panel is a plasma display. These display units are relatively thin and have a thickness in the order of about 35 mm. One of the preferred forms of display panel is made by Fujitsu and is identified as a "Full Color Plasma Display". These displays effectively operate as high-definition direct-view television monitors.

These displays generally contain about 640 horizontal display pixels and about 480 vertical pixels along with about 1920 horizontal display cells and 480 vertical display cells. Moreover, they operate with gradations of red, green and blue and present a viewing angle of about 140°. Internally, the display is usually comprised of an IF controller, a data controller, a random access memory, and a driver controller. Nevertheless, since the plasma display is available in the art, it is therefore neither illustrated nor described in any further detail herein.

The location of each of the aforesaid operating components within the housing does generate heat within the housing. For this purpose, the housing 72 is provided with a plurality of apertures 110 on the side walls thereof, as shown in FIG. 9. In like manner, the chassis is provided with aligned apertures 112, as also shown in FIG. 9. In this way, air-flow ventilation is allowed. Moreover, and if desired, either exhaust fans or air in-take fans could be provided in adjacent relationship to the openings 110 and 112. Other types of ventilation means could also be provided, if desired.

The entire housing 72 is mounted on a mounting plate or support plate 114, as best shown in FIG. 10 of the drawings. In this case, the support plate 114 is, in turn, secured to a wall or other support structure as, for example, the stand 66, as shown in FIG. 12. The mounting plate 114 is a provided with an upstanding protrusion 116 which extends through an opening (not shown) in the rear wall 100 of the housing. Thereafter, a locking pin 118 is provided for extension through the side walls of the housing and the opening in the protrusion 116. In this way, it is virtually impossible to remove the display sign from the mounting plate 114, unless one has authorized access to the interior of the housing 72.

However, it should be understood that other means for mounting the housing 72 to the mounting plate 114 could be provided for this purpose.

It is possible to construct the apparatus without the use of a separate chassis, such as the chassis 90. In this case, the individual operating components, such as the power supply 104, the power 108 and the computer 106, would all be directly mounted on the rear wall of the housing 72, in the manner as best illustrated in FIG. 11 of the drawings. In this way, the overall weight of the housing is reduced. The chassis does, in many cases, allow for easier assembly, although where weight constraint is a requirement, the chassis can be readily and easily eliminated.

Also located in the housing is a separate infrared communicating device 122 which is designed to enable a sound generation for blind or other disabled parties. This infrared communicating device 122 operates with those conventional systems in which the blind are provided with an earphone arrangement and a receiver capable of picking up signals from the device 122.

For purposes of further heat removal, it is also possible to include in the housing 72 a fan 124. Preferably, the fan would be located in the bottom wall of the housing when the housing is vertically disposed. In this way, an upwardly occurring air draft is formed within the housing. Nevertheless, it should be understood that additional fans could be located elsewhere within the housing for purposes of temperature control, if desired.

The display panel 64 may be disposed on the upper surface of the chassis, as aforesaid, or otherwise located within the housing. In addition, it may be connected to the electronics and located within the cover plate 74 in adjacent relationship to the transparent cover plate 80. However, the display panel is preferably provided with a film or layer 120 which reduces heat introduction into the housing and operates as a type of interference film. Nevertheless, the interference film could be located on the transparent cover plate 80 for this particular purpose. FIG. 12 shows a stacked arrangement in which the display panel 64 is provided with the interference film 130 and the outer transparent cover plate 80.

It has been found in connection with the present invention that it is preferable to use glass in place of any other type of transparent plastic sheet, such as a so-called "Plexiglass" sheet. For this purpose, the interference layer is approximately 1.5 mil thick. It has also been found that a plastic cover cannot be used for this purpose because of potential out gassing. Moreover, it has also been found preferable to have the interference film 130 mounted directly on a surface of the glass sheet. Thus, and in this case, the glass sheet 80 is shown with an interference film on its undersurface.

The interference film is preferably one which is radio frequency insulated and which is also an electrically conductive film. For this purpose, the film is grounded at it perimeter to the metal frame. In one of the preferred embodiments, the interference film is a multi-layer coating, usually and in which the various metal layers are applied by sputtering. The high electrical conductivity along with high light transmission makes the interference film an ideal film for shielding against radio frequency interference and other low resistance applications.

It is preferable to also include an air space between the cover plate 80 and the display panel 64. Thus, and for this purpose, a peripheral spacer block 132 extends around the periphery of the cover plate and the display panel 64, in the manner as best shown in FIG. 12, thereby creating an air pocket 134 therebetween. This has been found to be highly effective in further precluding radio frequency and electromagnetic energy interference, as well as to enable transmission of heat from the interior of the system. Moreover, this arrangement precludes emanation of radio frequency interference which can be generated by the plasma operated screen.

If desired, the interference film could be placed on the display panel, although it has been found in connection with the present invention that a much greater degree of efficiency is obtained when the interference film is applied to the cover sheet plate 80.

The display system of the present invention provides a unique advantage which has not been heretofore available. The display can be generated in this case as an analog display. Prior art systems, on a limited basis, have used computers to generate a display on a sign. However, that display is necessarily generated in a digital format and, thus, has significant limitations on the quality and the ability of a particular display to be generated. Contrariwise, in the present invention, a display, which may be generated from a photographic image, can be essentially recreated on a display sign from a remote source.

Thus, there has been illustrated and described a unique and novel display system which enables a display sign to be operated from a remote source and where a display can be generated at the sign based on signals from the remote source and which are transmitted to the display sign for generation of an analog display thereon. The display system and the display sign forming a part thereof thereby fulfill and meet all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described our invention, what we desire to claim and secure by Letters Patent is:

1. A display sign capable of generating a static display from a received electronic signal generated at and transmitted to said sign from a remote source, said display sign comprising:

a) an outer housing;

b) a computer controlled and plasma operated flat display panel on said housing and being observable to a large number of people in a group with wide angle viewing capacity;

c) window forming means on said housing allowing said display panel to be visible to a viewer;

d) processor means within said housing and receiving an electrical signal from a remote source representative of the display to be generated, said processor means causing generation of that static display in the display panel based on the signal received from the remote source; and e) a transparent sheet extending over and being spaced apart from said display panel to allow for a forced air flow past said panel to thereby enable a dissipation of heat from said housing and to prevent transmission of force to said relatively fragile display panel which might otherwise crack said display panel.

2. The display sign of claim 1 further characterized in that said display panel is a plasma operated display panel.

3. A display system for generating at a remote source a static non-continuous display in the form of individual fixed images for presentation on a display sign at a generally fixed location and which is electronically transmitted from the remote source to the display sign, said display system comprising:

a) display generating means at the remote source for generating a plurality of displays in the form of electronic signals capable of being transmitted;

b) means for transmitting electronic signals representative of the plurality of displays from the remote source to the display sign; and c) a readily transportable and completely self-contained display sign positionable at a generally fixed location for operation at that fixed location and which may be located at a substantial distance from the display generating means, said display sign being operable as a self-contained unit independently of any networking for generation of displays, said display sign comprising:

1) an electronically operable flat panel display member with wide angle viewing almost independent of angle of view by an individual for displaying of advertising and other information to a large group of people simultaneously at a public facility;

2) self-contained and dedicated computer operated processing means in said display sign for generating a static display from the electronic signals; and 3) memory means in said display sign forming part of said processing means and storing information delivered from the remote source in digital signal format as digital signals and allowing the digital signals to be reconverted to visible images which are statically displayed one at a time at the display sign enabling advertising and other information to be presented for promotion of products or services on a large screen format, and where a large number of different displays stored in said memory means can be displayed at time selected periods independently of the electronic signals from the display generating means.

4. The display system of claim 3 further characterized in that the electronic signals are transmitted from the remote source to the processing means through an electrical conductor.

5. The display system of claim 3 further characterized in that the electronic signals are transmitted from the remote source to the processing means through a wireless transmission means.

6. The display system of claim 3 further characterized in that said system comprises means in said display sign for sequencing a plurality of sequential displays which are generated at said remote source and transmitted to said display sign and which are re-generated from the stored digital signals and displayed at the display sign.

7. The display system of claim 3 further characterized in that said system comprises means in the display sign and associated with the processing means for holding a plurality of displays in the form of digital signals for ultimate presentation on said display member and presentation of said displays at any of the time selected periods.

8. The display system of claim 3 further characterized in that said flat panel display member is a high definition multi-color and back lighted plasma operated screen.

9. The display system of claim 3 further characterized in that said computer operated processor means comprises a memory means for storing and controlling the display of the electronic signals received from the remote source for immediate display or later display and after receipt of same, said display is independent of the remote source.

10. A method for generating a plurality of individual static displays at a remote source and electronically transmitting the displays to a readily transportable display sign located at a substantial distance from the remote source for presentation, said method comprising:

a) electronically generating a plurality of displays at a remote source with each in the form of a visual image;

b) converting the visual image to corresponding electronic signals at the remote site;

c) temporarily storing the electronic signals in a temporary storage at the remote site for potential further processing;

d) permanently storing the electronic signals at a permanent storage at the remote source for ultimate transmission to the display sign;

e) transmitting the electronic signals to a self-contained and dedicated computer processing means at the display sign and located in the display sign;

f) storing the fixed and non-continuous images of the displays in the form of digital signals in a memory means forming part of said processing means and which also forms part of the display sign;

g) positioning the display sign at a fixed location for operation at that fixed location for a display of advertising and other information to a group of people simultaneously at a public facility without need for electronic signal networking, such that the display sign operates as a self-contained and stand alone unit;

h) re-generating the display from the digital signals and statically displaying same on the display sign; and i) automatically controlling at the display sign the time of each display and the particular display which is regenerated at the display sign enabling the advertising and other information to be presented for promotion of products and services on a large screen format.

11. The method for generating the display of claim 10 further characterized in that the method comprises transmitting the electronic signals from the remote source to the display sign through an electrical conductor.

12. The method for generating the display of claim 10 further characterized in that the method comprises transmitting the electronic signals from the remote source to the display sign through wireless transmission means.

13. The method for generating the display of claim 10 further characterized in that the method comprises sequentially transmitting said plurality of displays from said remote source to said display sign and storing the digital signals at said memory means in said display sign, and providing display generating signals at said processing means for sequentially displaying said individual displays.

14. The method for generating the display of claim 10 further characterized in that said method generates the display on a plasma operated back lighted screen.

15. The method for generating the display of claim 10 further characterized in that said method comprises a sequencing capability for sequentially displaying each of the individual static displays for fixed periods of time which may be determined at said remote source, and after receipt of same the display thereof is independent of the remote source.

16. The method of generating the display of claim 10 further characterized in that said method comprises storing at the display sign and controlling the display of an image generated from a signal received from the remote source for immediate display or later display, and after receipt of same the display thereof is independent of the remote source.

17. A display generating system for generating a static non-continuous display in electronic format and in the form of fixed images at a source remote to and transmitting same to a display sign for display on said display sign, said system comprising:

a) scanner means at the remote source for scanning a previously prepared image and providing temporary image signal;

b) a temporary storage means for receiving and temporarily holding said temporary image signal;

c) keyboard means for introducing and receiving in said temporary storage means keyboard input signals to modify or add to the temporary image signal;

d) computer assist design means for receiving said temporary image signal and keyboard input signals and thereby processing and editing same in a predetermined format to provide electronic signals representative of a display;

e) permanent storage means at said display sign for receiving and holding said electronic signals so that said electronic signals which are fully processed can be later recreated into a display;

f) a readily transportable self-contained and stand alone display sign positionable at a fixed location for operation at that fixed location and which may be located at a substantial distance from the display generating means, said display sign having an electronically operable plasma operated flat panel display member which is back light for displaying of advertising and other information with high density resolution to a large group of people simultaneously with wide angle viewing almost independently of angle of view by an individual;

g) self-contained and dedicated computer operated processing means in said display sign for generating a static display from the signals generated at and transmitted from the remote source; and h) means for transmitting electronic signals representative of the plurality of displays from the remote source to the processing means at the display sign and allowing the electronic signals to be reconverted to visible images which are statically displayed one at a time at the display sign enabling advertising and information to be presented for promotion of products or services on a large screen format and without need of any electronic networking for generation of the displays.

18. The display generating system of claim 6 further characterized in that said system comprises editing means operating in conjunction with said computer assist design means.

19. A display sign capable of generating a static non-continuous display from a received electronic signal generated at and transmitted to said sign from a remote source, said display sign comprising:

a) a relatively transportable outer housing having an interior compartment and being constructed for operation at a fixed location;

b) a relatively thin plasma operated flat high definition display panel on said housing and being observable simultaneously to a group of viewers;

c) a self-contained dedicated computer processor means within the interior compartment of said housing and receiving electronic signals from a remote source representative of the sequential displays to be generated, said processor moans causing generation of sequentially displayable static displays in the display panel based on the signals received from the remote source for display of advertising and other information for promotion of products and services;

d) means on the exterior of said display housing to mount the housing to a fixed support without placing undue stress on the display panel;

e) a power supply means located in the interior compartment of said housing for operating said processor means and operating other electrically operable components in said housing; and f) ventilation means for causing an air flow through the housing to enable dissipation of heat generation in said housing.

20. The display sign of claim 19 further characterized in that said display panel is a plasma operated display panel.

21. The display sign of claim 19 further characterized in that a chassis is provided for removable insertion into said housing and which is generally snugly received therein.

22. The display sign of claim 21 further characterized in that said processor means is mounted on said chassis and said power supply is also mounted on said chassis for operation of said display panel.

23. The display sign of claim 21 further characterized in that the means on the exterior of said housing comprises a mounting plate which is located on the exterior of said housing and is secured through said housing to said chassis in order preclude unauthorized removal from a mounted location.

24. The display sign of claim 19 further characterized in that a display storage is associated with said processor means for storing an electronic signal equivalent to a display to be generated.

25. The display sign of claim 19 further characterized in that said display sign also comprises receiver means for receiving a transmitted electronic signal equivalent to a display to be stored.

26. The display sign of claim 19 further characterized in that an interference filter is on said sign and is capable of reflecting infrared radiation and a transmission of heat from said housing.

27. The display sign of claim 19 further characterized in that said power supply means comprises a first power supply for operating said processing means and a second power supply for operating other electrical components in said housing.

28. The display sign of claim 19 further characterized in that a lid extends over said interior compartment and closes same, said lid having an enlarged opening allowing for complete viewing of said display panel.

29. The display sign of claim 28 further characterized in that said ventilation means comprises a plurality of ventilation fans in said housing to cause movement of air through the interior compartment.

30. The display sign of claim 28 further characterized in that said flat display panel is located at said opening, and transparent protection sheet means covers said display panel allowing for viewing thereof.

31. A display sign capable of generating a static display from a received electronic signal generated at and transmitted to said sign from a remote source, said display sign comprising:

a) an outer housing;

b) a display panel on said housing and being observable to a viewer;

c) processor means within said housing and receiving an electrical signal from a remote source representative of the display to be generated, said processor means causing generation of that static display in the display panel based on the signal received from the remote source; and d) an interference filter on said sign and reflecting any infrared radiation and for enabling a transmission of heat from said housing.

32. The display sign of claim 31 further characterized in that said display panel is a plasma operated display panel.

33. The display sign of claim 31 further characterized in that a chassis is provided for removable insertion into said housing and which is generally snugly received thereein and which carries said display panel and said processor means.

* * * * *